US011306888B1

(12) United States Patent
Yang

(10) Patent No.: US 11,306,888 B1
(45) Date of Patent: Apr. 19, 2022

(54) ROTATING MECHANISM OF WATER LAMP HANDICRAFT

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 0 days.

(21) Appl. No.: 17/471,174

(22) Filed: Sep. 10, 2021

(51) Int. Cl.
*F21S 10/00* (2006.01)

(52) U.S. Cl.
CPC ..... *F21S 10/002* (2013.01)

(58) Field of Classification Search
CPC ..... F21S 10/002; F21V 33/00; F21V 33/0028
See application file for complete search history.

(56) References Cited

U.S. PATENT DOCUMENTS 10,825,366 B1 * 11/2020 Yang ..... G09F 19/12
2004/0229541 A1 * 11/2004 Liao ..... G09F 19/02
446/267

* cited by examiner

*Primary Examiner* — Thomas M Sember
(74) *Attorney, Agent, or Firm* — Leong C. Lei

(57) ABSTRACT

Disclosed is a rotating mechanism of a water lamp handicraft, including: a base; a magnetic turntable; a support base; a fluid dial; and a scenery platform. In the rotating mechanism, the fluid dial is sleeved over a shaft sleeve of the magnetic turntable in an interference fit, so that the connection between the magnetic turntable and the fluid dial is appropriate. When rotating, the magnetic turntable may directly drive the fluid dial to rotate without a need of a plurality of gears to drive the rotation, thereby reducing a quantity of parts, and stabilizing the structure between the fluid dial and the magnetic turntable.

10 Claims, 4 Drawing Sheets

ROTATING MECHANISM OF WATER LAMP HANDICRAFT

BACKGROUND

Technical Field

The present application relates to the field of water lamp handicraft technologies, and in particular, to a rotating mechanism of a water lamp handicraft.

Related Art

In daily life, some handicraft decorations are often placed on indoor desktops and cabinets. Such decorations are usually photo frames, toys, and figures, and only have a static ornamental function. Therefore, a crystal lamp decoration with sequins, glitter or decorations is designed in the current market, which uses manually inverted shaking or electric power to produce a visually fluid movement with the sequins, glitter or decorations inside the crystal lamp.

However, for this type of handicraft decorations, because a liquid is provided inside a water lamp, it is impossible to directly use electricity to drive decorations inside the water lamp to rotate. Therefore, in the market, a magnetic structure is designed to drive the decorations inside the water lamp to rotate. However, most of the existing mechanisms that use magnetic structures for rotation have complex and unstable structures, resulting in a relatively short service life of a magnetic rotating mechanism. This application is an application recreated by the creator based on the U.S. Pat. No. 10,825,366B1 filed by the creator.

SUMMARY

The objective of the present application is to provide a rotating mechanism of a water lamp handicraft with a stable structure and an adequate viewing effect.

In order to solve the above-mentioned technical problem, the present application may be implemented by using the following technical solutions:

A rotating mechanism of a water lamp handicraft comprises: a base, where a groove is arranged downward, and a shaft is arranged in the middle of the groove; a magnetic turntable, where the magnetic turntable is arranged in the groove and is provided with a shaft sleeve extending upward in the middle, the shaft sleeve is sleeved over the shaft, a first gear is further provided extending from the top of the shaft sleeve, and a bottom surface of the magnetic turntable is provided with at least one magnetic member; a support base, where the support base penetrates the shaft sleeve and is arranged above the magnetic turntable, and two ends of the support base are respectively connected to the base; a fluid dial, where the fluid dial is sleeved over the shaft sleeve in an interference fit and is located above the support base; a support cover, where the support cover penetrates the first gear and is arranged above the fluid dial, two ends of the support cover are respectively connected to the support base, and a second gear is arranged on the support cover and is engaged with the first gear; and a scenery platform, where the scenery platform comprises an end cover, an outer platform, and an inner platform that are sequentially arranged from bottom to top, the end cover covers the support cover, the outer platform is internally engaged with the second gear, and the inner platform is externally engaged with the second gear.

In an embodiment, a rotating mechanism of a water lamp handicraft comprises a base, where a groove is arranged downward, and a shaft is arranged in the middle of the groove; a magnetic turntable, where the magnetic turntable is arranged in the groove and is provided with a shaft sleeve extending upward in the middle, the shaft sleeve is sleeved over the shaft, a first gear is further provided extending from the top of the shaft sleeve, and a bottom surface of the magnetic turntable is provided with at least one magnetic member; a support base, where the support base penetrates the shaft sleeve and is arranged above the magnetic turntable, and two ends of the support base are respectively connected to the base; a fluid dial, where the fluid dial is sleeved over the shaft sleeve in an interference fit and is located above the support base; a support cover, where the support cover penetrates the first gear and is arranged above the fluid dial, two ends of the support cover are respectively connected to the support base, and a second gear is arranged on the support cover and is engaged with the first gear; and a scenery platform, where the scenery platform comprises an end cover, an outer platform, and an inner platform that are sequentially arranged from bottom to top, the end cover covers the support cover, and the outer platform is internally engaged with the second gear.

In an embodiment, fixing columns are arranged at edges on two sides of the groove, the two ends of the support base are respectively provided with fixing holes, and the support base is connected to the base by clamping the fixing columns in the fixing holes.

In an embodiment, the two ends of the support base are respectively provided with connecting holes, the two ends of the support cover are respectively provided with connecting columns, and the support cover is connected to the support base by clamping the connecting columns in the connecting holes.

In an embodiment, a third gear is arranged on the support base, and the third gear is in rotational engagement with the magnetic turntable.

In an embodiment, two groups of second gears are arranged, and are respectively arranged on the two sides of the support cover.

In an embodiment, a plurality of radial fins is arranged on a periphery of the fluid dial.

The beneficial effects of the present application are as follows: In the rotating mechanism of a water lamp handicraft of the present application, the shaft is arranged in the middle of the groove, and the shaft sleeve of the magnetic turntable is sleeved over the shaft, so that the magnetic turntable is arranged in the groove. In addition, the fluid dial is sleeved over the shaft sleeve of the magnetic turntable in an interference fit, so that the connection between the magnetic turntable and the fluid dial is appropriate. When rotating, the magnetic turntable may directly drive the fluid dial to rotate without a need of a plurality of gears to drive the rotation, thereby reducing a quantity of parts, and stabilizing the structure between the fluid dial and the magnetic turntable.

In addition, the support base is connected to the base, the support cover is mounted on the support base, and the second gear is arranged on the support base to be internally engaged with the outer platform and to be externally engaged with the inner platform, so that the outer platform and the inner platform are rotatable at the same time and rotate in opposite directions to eventually implement two-way double rotation, thereby improving the overall viewing effect of a handicraft. The outer platform and the inner platform may be supported by the support base and the support cover, and a rotation process of the outer platform and the inner platform is smooth.

Figure 1:
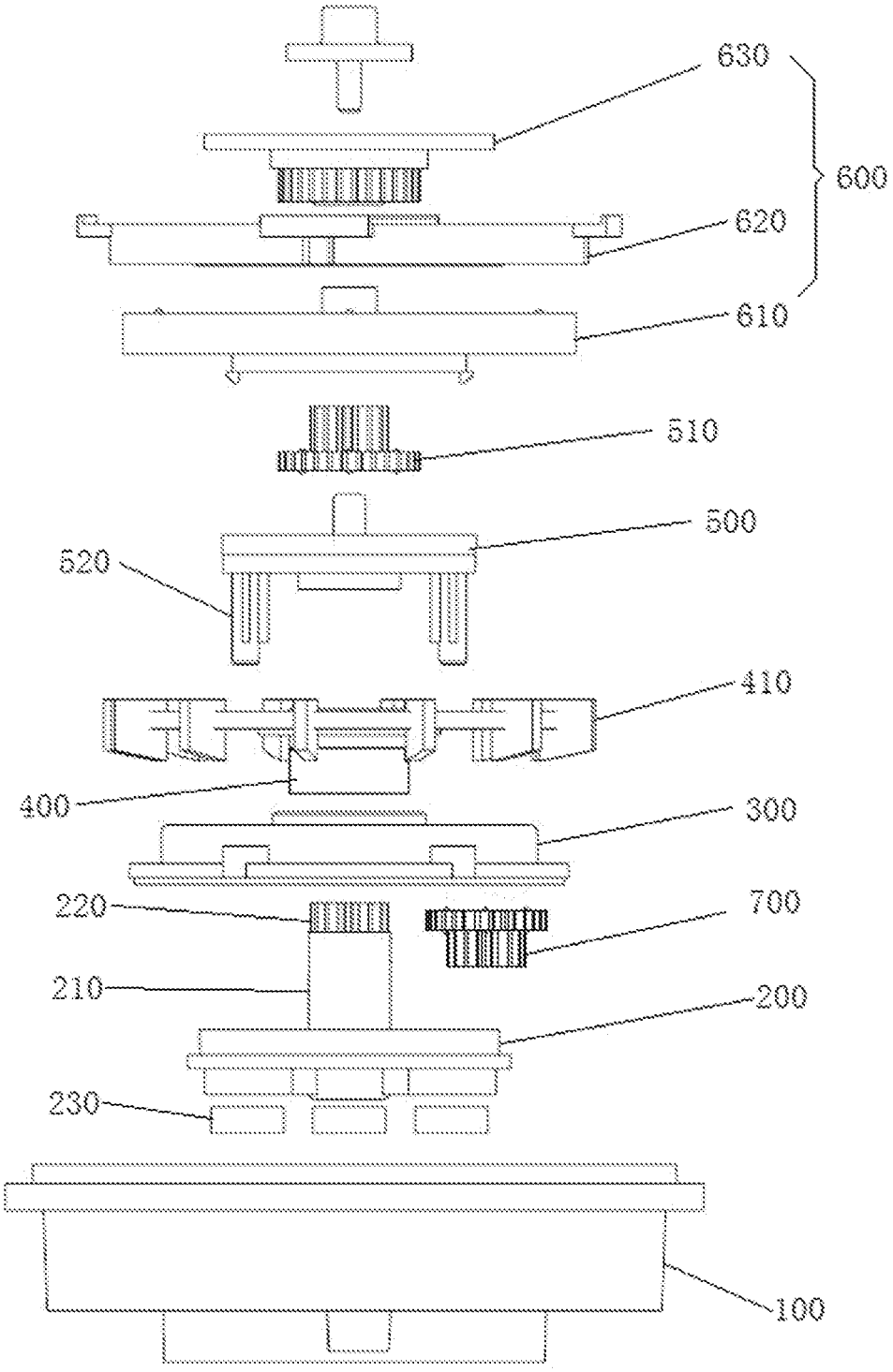
FIG. 1 is a schematic exploded plane view of Embodiment 1 of a rotating mechanism of a water lamp handicraft according to the present application.

As shown in the drawings: 100. base; 110. groove; 120. shaft; 130. fixing column; 200. magnetic turntable; 210. shaft sleeve; 220. first gear; 230. magnetic member; 300. support base 310. fixing hole; 320. adapter hole; 400. fluid dial; 410. fin; 500, support cover; 510. second gear; 520. connecting column; 600. scenery platform; 610. end cover; 620. outer platform; 630. inner platform; and 700. third gear.

DETAILED DESCRIPTION

To make the foregoing objects, features and advantages of the present application more comprehensible, detailed description is made to specific implementations of the present application below with reference to the accompanying drawings. In the following description, many specific details are described to give a full understanding of the present application. However, the present application may be implemented in many other manners different from those described herein. A person skilled in the art may make similar improvements without departing from the connotation of the present application. Therefore, the present application is not limited to the specific embodiments disclosed below.

It is to be noted that, when a component is referred to as "being fixed to" another component, the component may be directly on the other component, or an intervening component may be present. When a component is considered to be "connected to" another component, the component may be directly connected to the another component, or an intervening component may also be present. In contrast, when a component is referred to as being "directly on" or "directly connected to" another component, there is no intervening component. The terms "vertical", "horizontal", "left", and "right" and similar expressions used in this specification are merely used for the purpose of description.

Unless otherwise defined, meanings of all technical and scientific terms used in this specification are the same as those usually understood by a person skilled in the art to which the present application belongs. In this specification, terms used in the specification of the present application are merely intended to describe objectives of the specific embodiments, but are not intended to limit the present application. The term "and/or" used in this specification includes any and all combinations of one or more related listed items.

Embodiment 1

Referring to FIG. 1 to FIG. 4, a rotating mechanism of a water lamp handicraft includes: a base 100, where a groove 110 is arranged downward, and a shaft 120 is arranged in the middle of the groove 110; a magnetic turntable 200, where the magnetic turntable is arranged in the groove 110 and is provided with a shaft sleeve 210 extending upward in the middle, the shaft sleeve 210 is sleeved over the shaft 120, a first gear 220 is further provided extending from the top of the shaft sleeve 210, and a bottom surface of the magnetic turntable 200 is provided with at least one magnetic member 230; a support base 300, where the support base penetrates the shaft sleeve 210 and is arranged above the magnetic turntable 200, and two ends of the support base are respectively connected to the base 100; a fluid dial 400, where the fluid dial is sleeved over the shaft sleeve 210 in an interference fit and is located above the support base 300; a support cover 500, where the support cover penetrates the first gear 220 and is arranged above the fluid dial 400, two ends of the support cover are respectively connected to the support base 300, and a second gear 510 is arranged on the support cover 500 and is engaged with the first gear 220; and a scenery platform 600, where the scenery platform includes an end cover 610, an outer platform 620, and an inner platform 630 that are sequentially arranged from bottom to top, the end cover 610 covers the support cover 500, the outer platform 620 is internally engaged with the second gear 510, and the inner platform 630 is externally engaged with the second gear 510.

Specifically, the rotating mechanism in this embodiment is arranged inside a water lamp body, and the water lamp body is provided with a fluid inside. Therefore, the bottom of the water lamp body is fluid tightly connected to the base 100 of the rotating mechanism, and a driving mechanism is further arranged under the water lamp body for driving the rotating mechanism to rotate.

In this embodiment, to stabilize the structure of the rotating mechanism, a groove 110 is arranged in the middle of the base 100, and the shaft 120 is arranged in the middle of the groove 110. The shaft sleeve 210 in the middle of the magnetic turntable 200 is sleeved over the shaft 120, so that the magnetic turntable 200 is arranged in the groove 110, and the bottom of the magnetic turntable 200 is attached to the bottom of the groove 110. In addition, the middle of the fluid dial 400 is directly sleeved over the shaft sleeve 210 of the magnetic turntable 200, and the fluid dial 400 is connected to the magnetic turntable 200 in an interference fit, thereby facilitating the mounting of the fluid dial 400. When the magnetic turntable 200 is driven by a magnetic driving member to rotate, the magnetic turntable may directly drive the fluid dial 400 to rotate without using gears or other means to drive the rotation, thereby reducing a quantity of parts, and stabilizing the structure between the fluid dial 400 and the magnetic turntable 200.

In addition, to improve the viewing effect of a handicraft, the double-platform scenery platform 600 is used in this embodiment. The scenery platform 600 includes an end cover 610, an outer platform 620, and an inner platform 630. In order to ensure a two-way double rotation of the outer platform 620 and the inner platform 630 and a stable structure and smooth rotation, the support base 300 penetrates the shaft sleeve 210 of the magnetic turntable 200 to connect the two ends to the base 100, and the support cover 500 penetrates the first gear 220 at the top end of the shaft sleeve 210 to connect to the support base 300. In addition, the second gear 510 is further arranged on the support cover 500 and is engaged with the first gear 220 at the top end of the sleeve 210, and the end cover 610 covers the support cover 500. After the end cover covers the support cover, the second gear 510 is further internally engaged with the outer platform 620, and is externally engaged with the inner platform 630. Finally, the second gear 510 is driven by the first gear 220 to rotate, and the second gear 510 respectively drives the outer platform 620 and the inner platform 630 to rotate, and enables the outer platform 620 and the inner platform 630 to rotate in opposite directions. Finally, a two-way double rotation is implemented. In addition, the structure between the outer platform 620 and the inner platform 630 is stabilized by using the support base 300, the support cover 500, and the end cover 610, and the two-way double rotation is smooth.

Figure 2:
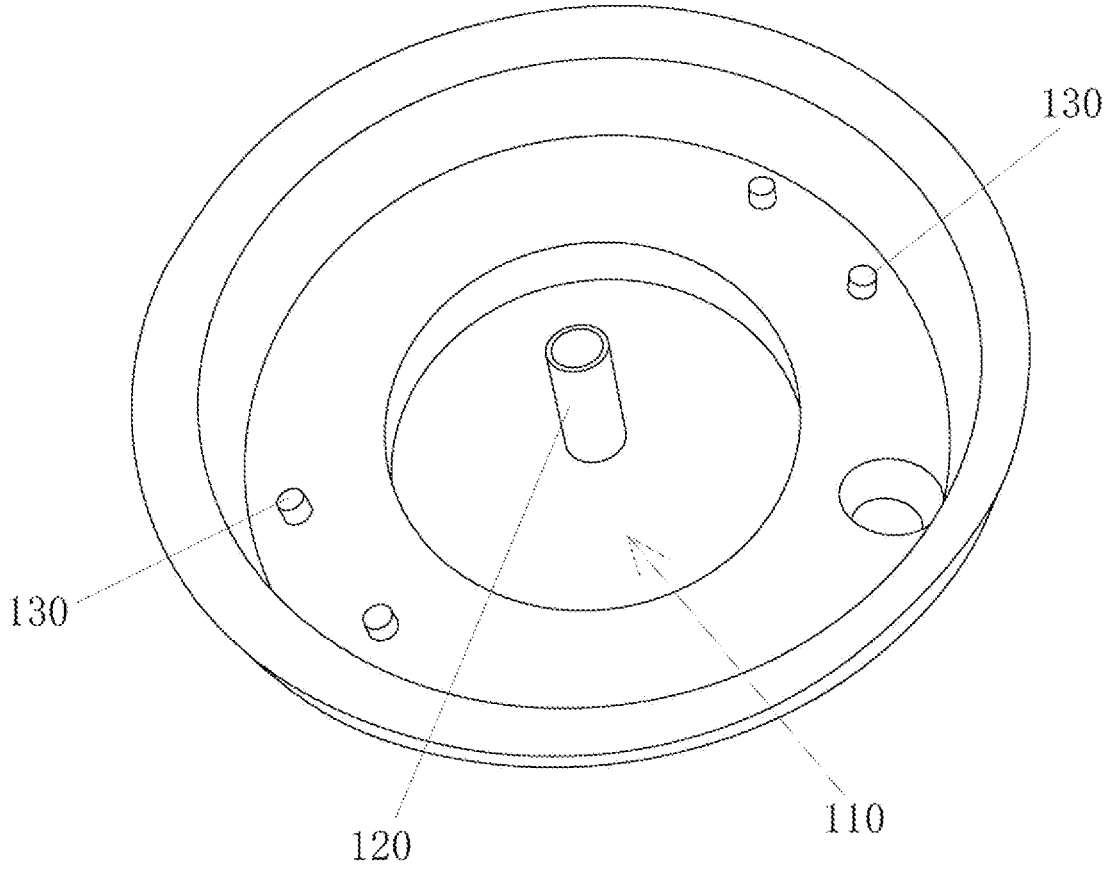
FIG. 2 is a schematic structural diagram of a base of Embodiment 1 of a rotating mechanism of a water lamp handicraft according to the present application.
Figure 3:
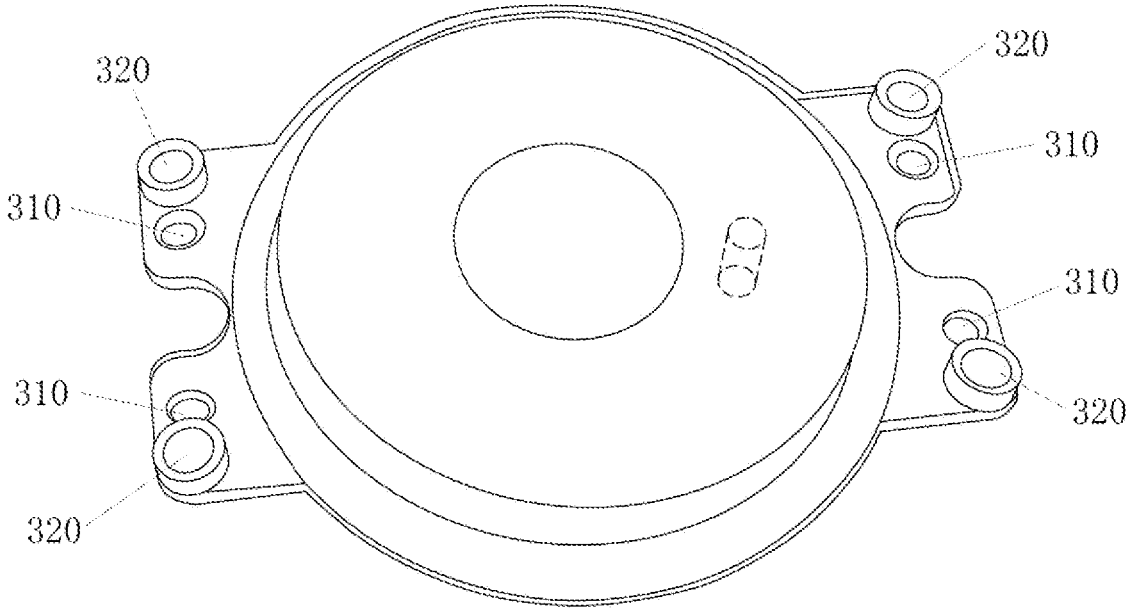
FIG. 3 is a schematic structural diagram of a support base of Embodiment 1 of a rotating mechanism of a water lamp handicraft according to the present application.

Referring to FIG. 2 and FIG. 3, fixing columns 130 are arranged at edges on two sides of the groove 110, and the two ends of the support base 300 are respectively provided with fixing holes 310. The support base 300 is connected to the base 100 by clamping the fixing columns 130 in the fixing holes 310.

In order to mount the support base 300 and the base 100, the fixing columns 130 are arranged at edges on the two sides of the groove 110 of the base 100, and the fixing holes 310 are respectively arranged at the two ends of the support base 300. During mounting, the shaft sleeve 210 of the magnetic turntable 200 is penetrated by the middle of the support base 300, and the fixing holes 310 at the two ends of the support base 300 are sleeved over the fixing columns 130 of the base 100 to cover the magnetic turntable 200, and connect the support base 300 to the base 100. Finally, the structure between the support base 300, the magnetic turntable 200, and the base 100 is stable and compact.

Figure 4:
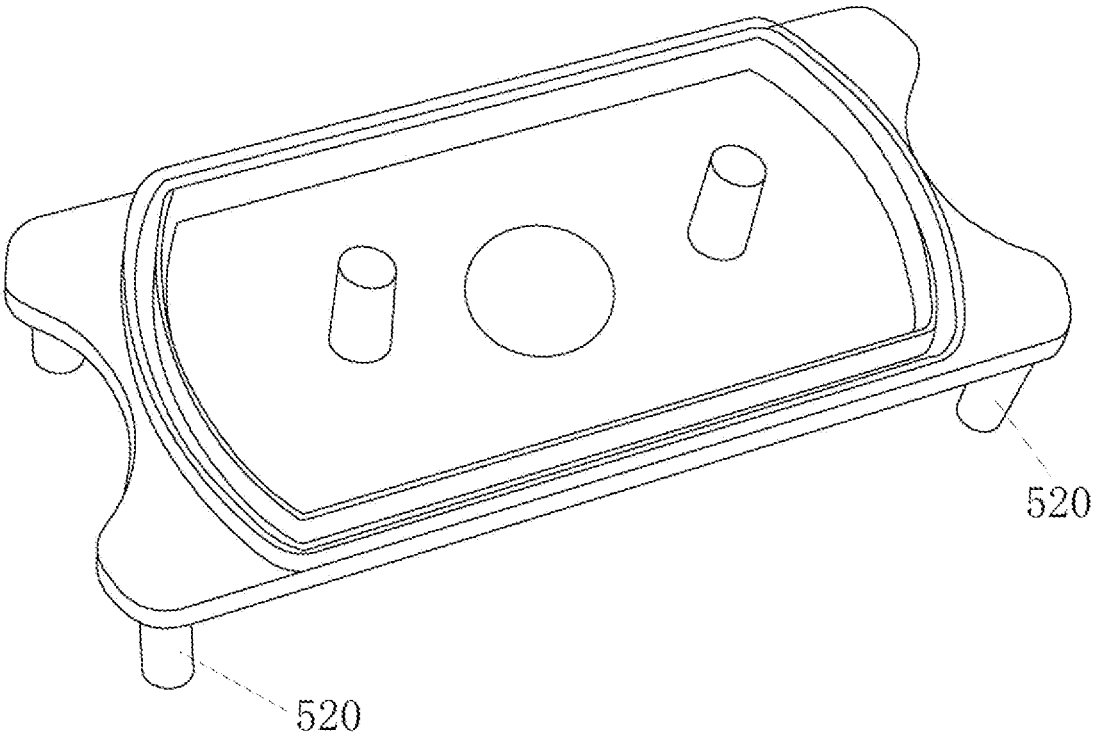
FIG. 4 is a schematic structural diagram of a support cover of Embodiment 1 of a rotating mechanism of a water lamp handicraft according to the present application.
Figure 5:
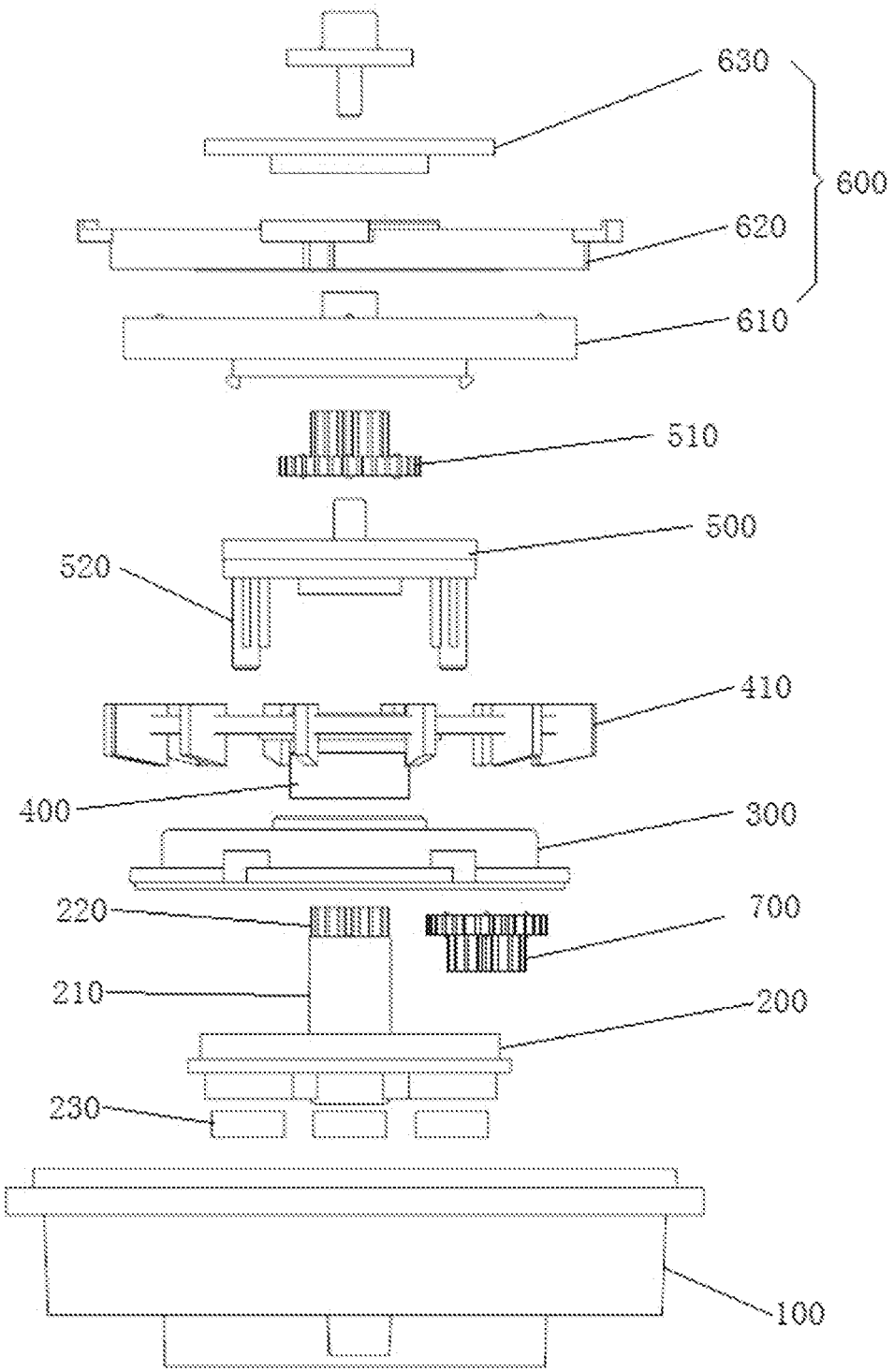
FIG. 5 is a schematic exploded plane view of Embodiment 2 of a rotating mechanism of a water lamp handicraft according to the present application.

Referring to FIG. 3 and FIG. 4, the two ends of the support base 300 are respectively provided with connecting holes 320, and the two ends of the support cover 500 are respectively provided with connecting columns 520. The support cover 500 is connected to the support base 300 by clamping the connecting columns 520 in the connecting holes 320.

Similarly, in order to improve the stability of the rotating mechanism, the two ends of the support base 300 are respectively provided with the connecting holes 320, and the two ends of the support cover 500 are provided with the connecting columns 520. During mounting, the first gear 220 is penetrated by the middle of the support cover 500, and the connecting columns 520 at the two ends are directly clamped in the connecting holes 320. In this way, the connection between the support cover 500 and the support base 300 is completed to support the scenery platform 600, and the end cover 610 of the scenery platform 600 covers the support cover 500. Finally, the structure of the outer platform 620 and the inner platform 630 of the scenery platform 600 is stable, and the rotation is smooth.

Referring to FIG. 1, to ensure that the magnetic turntable 200 rotates smoothly, a third gear 700 is arranged on the support base 300, and the third gear 700 is in internally rotational engagement with an inner ring of the magnetic turntable 200. When the magnetic turntable 200 is driven by a driving mechanism to rotate, the third gear 700 is driven to rotate at the same time. The magnetic turntable 200 can rotate more smoothly through the rotation of the third gear 700.

Certainly, to ensure that the outer platform 620 and the inner platform 630 rotate smoothly, in this embodiment, two groups of second gears 520 are arranged, and are respectively arranged on the two sides of the support cover 500, and the bottom ends are engaged with the first gear 220, and the top ends are internally engaged with the outer platform 620 and are externally engaged with the inner platform 630. The second gears 520 are respectively arranged on the two sides to be engaged with the outer platform 620 and the inner platform 630, to enable the outer platform 620 and the inner platform 630 to rotate more smoothly.

Referring to FIG. 1, to better agitate a liquid inside the water lamp body, a plurality of radial fins 410 is arranged on a periphery of the fluid dial 400. The plurality of fins 410 may effectively agitate the liquid inside to better facilitate flowing of the liquid, so as to improve the viewing effect of the handicraft.

Embodiment 2

In this embodiment, a rotating mechanism of a water lamp handicraft is basically the same as that in Embodiment 1. A main difference is that the scenery platform 600 includes the end cover 610, the outer platform 620, and the inner platform 630 that are sequentially arranged from bottom to top, the end cover 610 covers the support cover 500, the outer platform 620 is internally engaged with the second gear 510, and the inner platform 630 is not connected to the second gear 510.

Specifically, when the driving mechanism under the water lamp body operates, the magnetic turntable 200 is magnetically driven to rotate. When the magnetic turntable 200 rotates, the first gear 220 at the top of the sleeve 210 rotates along. Because the first gear 220 is engaged with the second gear 510 on the support cover 500, when the first gear 220 rotates, the second gear 510 is driven to rotate. In addition, because the second gear 510 is internally engaged with the outer platform 620, the outer platform 620 may also be driven to rotate. In this way, a scenery on the outer platform 620 rotates. Because the inner platform 630 is not connected to the second gear 510, a scenery on the inner platform 630 remains static. Finally, the overall viewing effect of the handicraft can be improved.

Certainly, in the scenery platform 600, the inner platform 630 may be externally engaged with the second gear 510, whereas the outer platform 620 is not connected to the second gear 510. In this case, the scenery on the outer platform 620 does not rotate, whereas the scenery on the inner platform 630 rotates, which may also improve the overall viewing effect of the handicraft.

The foregoing shows and describes basic principles, main features of the present application and advantages of the present application. A person skilled in the art may smoothly implement this application according to the accompanying drawings and the foregoing descriptions of this specification. However, a person skilled in the art may make some equivalent variations such as alterations, modifications, and evolutions by using the disclosed technical content without departing from the scope of the technical solution of this application, and such equivalent variations are all equivalent embodiments of this application. Meanwhile, any equivalent variations such as alterations, modifications, and evolutions made to the foregoing embodiments according to the technical essence of this application shall still fall within the protection scope of the technical solution of this application.

What is claimed is:

1. A rotating mechanism of a water lamp handicraft, comprising:

a base, wherein a groove is arranged downward, and a shaft is arranged in the middle of the groove;

a magnetic turntable, wherein the magnetic turntable is arranged in the groove and is provided with a shaft sleeve extending upward in the middle, the shaft sleeve is sleeved over the shaft, a first gear is further provided extending from the top of the shaft sleeve, and a bottom surface of the magnetic turntable is provided with at least one magnetic member;

a support base, wherein the support base penetrates the shaft sleeve and is arranged above the magnetic turntable, and two ends of the support base are respectively connected to the base;

a fluid dial, wherein the fluid dial is sleeved over the shaft sleeve in an interference fit and is located above the support base;

a support cover, wherein the support cover penetrates the first gear and is arranged above the fluid dial, two ends of the support cover are respectively connected to the support base, and a second gear is arranged on the support cover and is engaged with the first gear; and a scenery platform, wherein the scenery platform comprises an end cover, an outer platform, and an inner platform that are sequentially arranged from bottom to top, the end cover covers the support cover, the outer platform is internally engaged with the second gear, and the inner platform is externally engaged with the second gear.

2. The rotating mechanism of a water lamp handicraft according to claim 1, wherein a base, wherein a groove is arranged downward, and a shaft is arranged in the middle of the groove;

a magnetic turntable, wherein the magnetic turntable is arranged in the groove and is provided with a shaft sleeve extending upward in the middle, the shaft sleeve is sleeved over the shaft, a first gear is further provided extending from the top of the shaft sleeve, and a bottom surface of the magnetic turntable is provided with at least one magnetic member;

a support base, wherein the support base penetrates the shaft sleeve and is arranged above the magnetic turntable, and the two ends of the support base are respectively connected to the base;

a fluid dial, wherein the fluid dial is sleeved over the shaft sleeve in an interference fit and is located above the support base;

a support cover, wherein the support cover penetrates the first gear and is arranged above the fluid dial, two ends of the support cover are respectively connected to the support base, and a second gear is arranged on the support cover and is engaged with the first gear; and a scenery platform, wherein the scenery platform comprises an end cover, an outer platform, and an inner platform that are sequentially arranged from bottom to top, the end cover covers the support cover, and the outer platform is internally engaged with the second gear.

3. The rotating mechanism of a water lamp handicraft according to claim 2, wherein fixing columns are arranged at edges on two sides of the groove, the two ends of the support base are respectively provided with fixing holes, and the support base is connected to the base by clamping the fixing columns in the fixing holes.

4. The rotating mechanism of a water lamp handicraft according to claim 3, wherein the two ends of the support base are respectively provided with connecting holes, the two ends of the support cover are respectively provided with connecting columns, and the support cover is connected to the support base by clamping the connecting columns in the connecting holes.

5. The rotating mechanism of a water lamp handicraft according to claim 2, wherein a plurality of radial fins is arranged on a periphery of the fluid dial.

6. The rotating mechanism of a water lamp handicraft according to claim 1, wherein fixing columns are arranged at edges on two sides of the groove, the two ends of the support base are respectively provided with fixing holes, and the support base is connected to the base by clamping the fixing columns in the fixing holes.

7. The rotating mechanism of a water lamp handicraft according to claim 6, wherein the two ends of the support base are respectively provided with connecting holes, the two ends of the support cover are respectively provided with connecting columns, and the support cover is connected to the support base by clamping the connecting columns in the connecting holes.

8. The rotating mechanism of a water lamp handicraft according to claim 7, wherein a third gear is arranged on the support base, and the third gear is in rotational engagement with the magnetic turntable.

9. The rotating mechanism of a water lamp handicraft according to claim 8, wherein two groups of second gears are arranged, and are respectively arranged on the two sides of the support cover.

10. The rotating mechanism of a water lamp handicraft according to claim 1, wherein a plurality of radial fins is arranged on a periphery of the fluid dial.

* * * * *